US005578783A

United States Patent [19]

Brandeis

[11] Patent Number: 5,578,783

[45] Date of Patent: Nov. 26, 1996

[54] RAM ACCELERATOR SYSTEM AND DEVICE

[75] Inventor: Julius Brandeis, Haifa, Israel

[73] Assignee: State of Israel, Ministry of Defence, Rafael Armaments Development Authority, Haifa, Israel

[21] Appl. No.: 358,346

[22] Filed: Dec. 19, 1994

[30] Foreign Application Priority Data

Dec. 20, 1993 [IL] Israel ..... 108095

[51] Int. Cl.[6] ..... F41F 1/00

[52] U.S. Cl. ..... 89/8; 60/270.1; 102/490

[58] Field of Search ..... 60/270.1; 89/7, 89/8; 102/490, 511

[56] References Cited

U.S. PATENT DOCUMENTS

| | | | |
|---|---|---|---|
| 3,008,669 | 11/1961 | Tanczos et al. | 60/270.1 |
| 3,213,802 | 10/1965 | Foa | 104/138.1 |
| 3,253,511 | 5/1966 | Zwicky | 89/8 |
| 3,811,280 | 5/1974 | Wharton et al. | 60/207 |
| 3,951,037 | 4/1976 | Bornand | 89/1.3 |
| 4,091,731 | 5/1978 | Schadow et al. | 102/372 |
| 4,593,620 | 6/1986 | Pettersson et al. | 102/372 |
| 4,917,335 | 4/1990 | Tidman | 244/130 |
| 4,938,112 | 7/1990 | Hertzberg | 89/7 |
| 4,982,647 | 1/1991 | Hertzberg et al. | 89/8 |
| 5,202,525 | 4/1993 | Coffinberry | 60/218 |

FOREIGN PATENT DOCUMENTS

| | | | |
|---|---|---|---|
| 0248340 | 12/1987 | European Pat. Off. . | |
| 825752 | 3/1938 | France | 102/511 |
| 51021 | 5/1941 | France | 102/511 |
| 4120095 | 12/1992 | Germany . | |

*Primary Examiner*—Michael J. Carone
*Attorney, Agent, or Firm*—Michael N. Meller

[57] ABSTRACT

A method for accelerating projectiles comprises introducing the projectile into an accelerator barrel, feeding a combustible gas mixture into said barrel and igniting said mixture to accelerate the projectile, and is characterized in that a fluid is stored in the projectile and is ejected therefrom into the space between the projectile and the barrel. Suitable accelerator systems are disclosed.

42 Claims, 8 Drawing Sheets

RAM JET IN TUBE MODES

SUPERSONIC COMBUSTION
OR DETONATION

EXTERNAL MODES

SUBSONIC COMBUSTION MODE

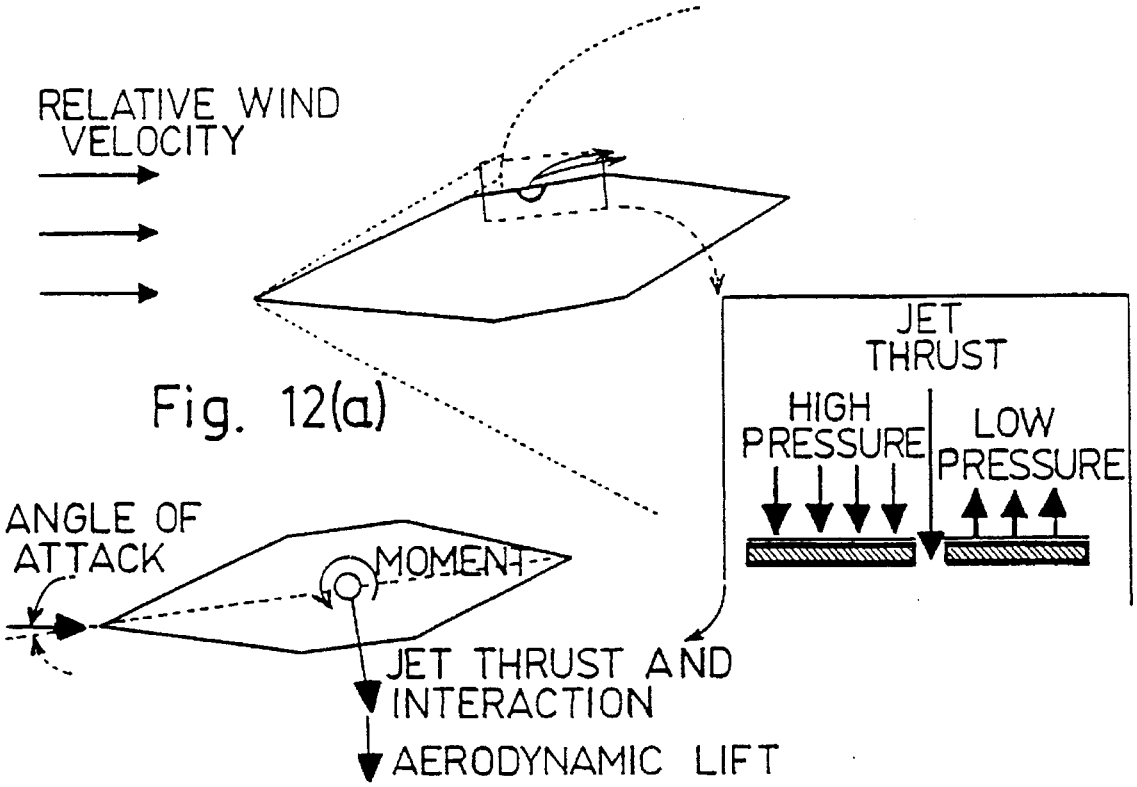
Fig. 12(a)
Fig. 12(b)
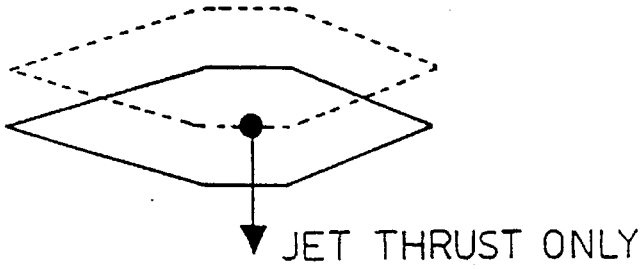
Fig. 12(c)

RAM ACCELERATOR SYSTEM AND DEVICE

FIELD OF THE INVENTION

The invention relates to a system and a device, including a projectile, for chemically accelerating the projectile to hypersonic speed.

BACKGROUND OF THE INVENTION

The RAM accelerator (or RAM cannon) is a device for accelerating projectiles to velocities vastly exceeding those possible using conventional guns. The concept (first demonstrated by Hertzberg et al., The Ram Accelerator: a New Chemical Method of Achieving Ultra-High Velocity, 37th Meeting of the Aeroballistic Range Association, Quebec, Canada, Sep. 9–12, 1986, and AIAA Journal, Vol. 26, No. 2, February 1988, pp. 195–203) uses a tube filled with reactive gas mixture consisting of fuel, oxidizer and, often, an inert gas as dilutant. The projectile is then injected into the tube at supersonic speed by using a conventional cannon. By careful design of the projectile and the tube, and appropriate choice of the gas combination, a system of shockwaves is established between the projectile and the tube, such that a chemical reaction takes place only at the predetermined location on the projectile. The shock wave from the bow of the projectile is reflected from the barrel at least once (more shock reflections may also be needed) and ideally impinges on the afterbody of the projectile. The passage through the two shocks heats and compresses the gas sufficiently, to initiate the desired chemical process (in this case supersonic combustion or oblique detonation) downstream of the reflected shock. The high pressure then acts on the projectile afterbody to accelerate it down the tube.

The specific, shock-induced combustion process that occurs is determined by the ambient gas mixture's composition and pressure, and the projectile's shape and velocity. For the oblique detonation to take place, the projectile must travel at a velocity exceeding the Chapman-Jouguet (C-J) velocity of the gas mixture (termed the super-detonative range). Detonation mode can be defined (following Pratt, D. T., Humphrey J. W. and Glenn D. F., Morphology of Standing Oblique Detonatiojm Waves, Journal of Propulsion, v.7, No. 5,. Sept–Oct. 1991, pages 837–45) as the process in which the shock is followed so closely by the supersonic combustion wave, that the two become strongly coupled and merge into a single detonation wave. It is feasible also that the supersonic combustion process follows the shock with sufficient delay (induction time) that it does not strongly affect the shock. The combustion process is thus decoupled from the shock. This is referred to as supersonic combustion, rather than detonation, although by some definitions the two are equivalent. Examples of such supersonic combustion modes can be found in Bogdanoff, D. W., Ram Accelerator Direct Space Launch System: New Concepts, J. Propulsion and Power, Vol. 8, No. 2, March–April 1992, pages 481–490, and Bruckner, A. P. and Knowlen, C., Overview of Ram Accelerator Technology, National Shock Wave Symposium, Institute of Fluid Sciences, Tohoku University, Sendai, Japan, 14–16 January 1993.

Other propulsive modes utilizing subsonic combustion have been more widely considered and analyzed. These include the mechanically and thermally choked modes discussed in the references mentioned hereinbefore. The thermally choked mode, where the combustion occurs in the wake of the blunt rear body segment thus maintaining a normal shock wave on the tapered tail section, is applicable to projectile speeds below the C-J velocity (termed the sub-detonative range). This mode is frequently used in the current ram accelerators operating in the sub-detonative range.

It is clear that the ignition process must be stationary relative to the projectile, and therefore that this mechanism is strongly dependent on the speed, shock strength and the distance between the projectile and the tube, as well as the reactive atmosphere's composition.

In all these systems, the accelerator barrel must be sufficiently narrow as to produce the reflected detonation waves. They may be called "internal propulsion" systems. To get away from the constraints of the tube geometry and thus the need for shock reflections, Jozef Rom proposed, in U.S. Pat. No. 4,932,306, corresponding to IL 82200, a ram accelerator which has a barrel that is wide enough not to produce reflected detonation waves, but detonation waves are produced by a shoulder portion in the form of a step, provided on the outer surface of the projectile. This is possible only if the gas properties and conditions are favorable, and the projectile's velocity is in the super-detonative range. Since the shoulder should be as small as possible, the leading edge shock on the projectile is assumed to provide a large part of the compression and heating of the gas mixture. This method allows, in essence, an external, tube independent propulsion mode. A simpler tube design would be possible both structurally and geometrically. The shoulder in the projectile geometry is, however, a drag and heat source and a way of keeping the projectile centered during the traverse must be assured. It is assumed that the guiding fins used in the original concept may not be practical because of the large distance betwen the projectile and the tube. Rom's system of propulsion may be called "external propulsion" system.

In U.S. Pat. No. 5,121,670 to Edward B. Fisher, a ram accelerator is described wherein a gas mixture is injected into the ram accelerator barrel at least at two points thereof, for example, one at the muzzle end and one at the inlet end, so as to produce an initial elevated pressure in the barrel before the projectile passes through the gas. The shock wave produced by the interaction of the two gas charges produces the desired elevated pressure. The shock and the compressed gas travel forward, with the projectile behind them. The shock reflected from the barrel ignites the gas mixture at the rear of the projectile.

The prior art ram accelerators are not fully satisfactory. For instance, premature ignition due to a shock pattern established by the forward parts of the projectile may occur and produce destructive deceleration of the projectile. Further, the known ram accelerator systems are not flexible insofar as the size of the barrel is concerned, for the barrel must have a small or a large diameter, depending on the system chosen. In the systems described by Hertzberg or by Fisher, the final gas pressures are very high, and thick and heavy barrels are required. In the system described by Rom, on the other hand, the constraint of the barrel is lifted, and the step in the projectile surface, which must have a significant height to generate the required strong shock, produces a large amount of unwanted drag, as well as a local heat problem.

It is a purpose of this invention to eliminate the drawbacks of the known ram accelerators.

It is another purpose of the invention to provide an accelerator system that can be used with a narrow barrel in internal propulsion ram mode, or with wide barrel for external propulsion, as needed.

It is a further purpose of the invention to provide a desirable control of the combustion process along the barrel.

It is a still further purpose of the invention to prevent premature ignition of the gas mixture due to shock patterns.

It is a still further purpose of the invention to anchor the reaction, either deflagration or detonation, to the jet.

It is a still further purpose of the invention to facilitate a method for truly external propulsion in the atmosphere, wherein the ambient air is utilized as the oxidizer.

It is a still further purpose of the invention to integrate the injection and gas supply mechanism used during acceleration in the device, either partially or in whole, with a jet steering system, to provide vehicle control during flight, and possibly during launch.

Other purposes and advantages of the invention will become apparent as the description proceeds.

SUMMARY OF THE INVENTION

The invention provides a method for accelerating projectiles, comprising introducing the projectile into an accelerator barrel, feeding a combustible gas mixture into said barrel and igniting said mixture to accelerate the projectile, characterized in that a fluid, preferably compressed gas, is stored in the projectile and is ejected therefrom into the space between the projectile and the barrel, whereby combustion, specifically a deflagration or detonation, is preferably created.

It should be noted that, while the reference will always be made in this application to the use of gases and/or gas jets, liquids could be used in place of gases, and this statement should be considered as implicitly repeated whenever reference is made to gases and/or gas jets.

It should be understood that the jet ejected from the projectile causes a shock wave, which ignites the ambient mixture, because it acts effectively as an obstacle and thus interacts with said mixture (which is in relative motion with respect to the projectile). Further, the fluid ejected in the jet acts in a chemical way to increase the energy available to be released in the combustion process.

The amount of gas stored and ejected is a small fraction of the projectile mass. The pressure required for its ejection may be achieved by: a) preloading it at the desired pressure; b) compressing it by mechanical means such as a piston-type arrangement, to the desired pressure (in which case the driving force will preferably come from the high acceleration during the injection stage); c) by a combination of the a) and b) means; d) by generating it by a chemical gas generator; e) by an explosively driven piston, which may be set off before launch. The gas is preferably retained within the projectile by appropriate closure means, and means are provided for removing said closure means at the appropriate moment.

The invention also provides a ram accelerator system, comprising, in combination with an accelerator barrel and a projectile, means for storing compressed gas in the projectile and ejecting it therefrom into the space between the projectile and the barrel. Said ram accelerator system may be designed to operate in both the internal or the external propulsion mode, as desired.

In a preferred form of the invention, the ram accelerator system comprises: 1- a projectile; 2 - an accelerator barrel containing combustible gas mixture; 3 - means for imparting to the projectile the initial velocity at its introduction into the barrel, viz. a pre-accelerator gun; 4 - a stripper and venting section, for stripping separable and disposable elements (such sabot segments and pusher plate, hereinafter described) from the projectile and venting gun gases; and 5 - means for storing gas in the projectile, pressurizing it and ejecting it as the projectile travels through the accelerator barrel. In another preferred embodiment of the invention, gas retaining means are provided in or in combination with the projectile and means are provided for removing or inactivating said retaining means at an appropriate position in the travel of the projectile. In still another preferred embodiment of the invention the barrel is composed of a plurality of lengthwise segments.

The barrel will have the diameter desired for the propulsion mode chosen. In the internal propulsion mode the barrel diameter is typically 20–25% greater than the projectile diameter. In the external propulsion mode the barrel diameter should be at least equal to 3–4 projectile diameters (or, alternatively, about half of the projectile length, depending on the slenderness ratio) in order to prevent shock wave reflections at the barrel from hitting the projectile; and, while there is not definite upper limit to said barrel diameter, it is clear that the larger it is, the greater the weight of the barrel and of the gas contained therein, not all of which is consumed.

DESCRIPTION OF THE DRAWINGS

In the drawings:

FIG. 12*a*, 12*b* and 12*c* schematically illustrate the use of the jets to control a vehicle during flight.

DETAILED DESCRIPTION OF PREFERRED EMBODIMENTS

Figure 1:
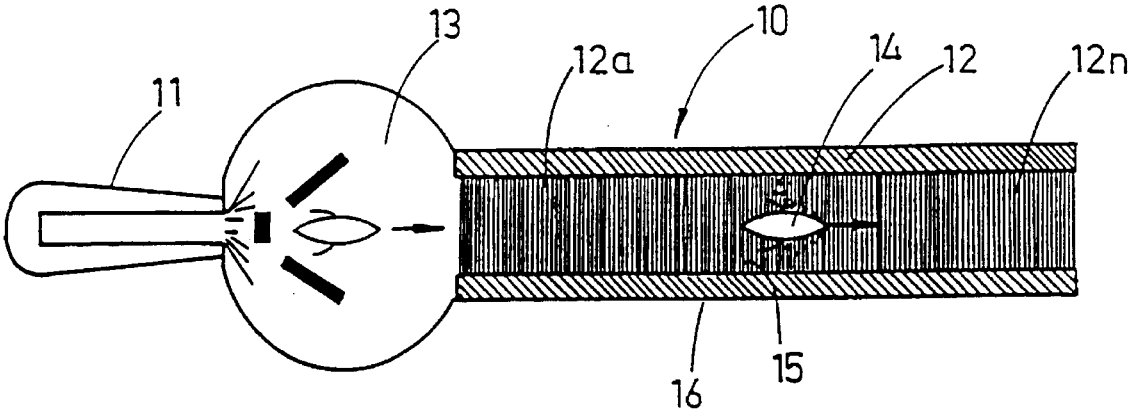
FIG. 1 schematically illustrates the general structure of a ram accelerator system according to an embodiment of the invention.

The invention is based on a concept for achieving ignition and propulsion in ram accelerators using an external propulsion mode which is tube independent (but can also be used in internal propulsion mode) and takes advantage of the shock system established when an underexpanded jet is ejected from the projectile moving at high supersonic speeds. The effect of the jet injection into a supersonic main stream is to produce a small, wedge-like upstream separated region characterized by a weak, oblique shock wave and a rise in static pressure, followed by a strong bow shock adjoining the jet. In fact, the jet interaction shock structure and flow field are highly analogous with those due to the forward-facing step. This is demonstrated numerically in Brandeis, J., Numerical Study of Jet Interaction at Super- and Hypersonic Speeds for Flight Vehicle Control, Paper ICAS 92-4-9.1, Procedings, 18th Congress, International Council of the Aeronautic Sciences, Beijing, China, Sep. 21–25, 1992, in which the computed results for the jet and step flow fields are presented, including wall pressure distributions. Downstream of the jet location, the injected gas blankets the wall while mixing with the ambient stream. The bow shock due to the jet is expected to provide conditions for a detonation or deflagration in the gas. In the combustion mode, the bow shock due to the jet must heat the mixture above the ignition point. Supersonic combustion can then take place downstream of the jet, and the resulting high pressure would act on the tapered tail of the projectile to produce thrust. Under certain conditions and assuming the projectile's velocity to be in the super-detonative range, the shock will give rise to detonation within the gas mixture. In this case the shock and the detonation wave become closely coupled and the resulting high pressure accelerates the projectile. Both of these modes are practical in the external and internal (tube dependent) configurations, using the proposed jet interaction scheme for ignition. Other modes of operation, such as thermally and mechanically choked modes, utilizing subsonic combustion, are possible with the present method for the internal propulsion ram accelerator.

A very energetic combination of gases for use in the propulsive mixture in the ram accelerator barrels, is the $H_2$—$O_2$ mixture with possibility of dilutants. The injectant gas could then be hydrogen or oxygen. The detonation velocity of such mixture would be about 3 km/s, therefore it would be appropriate only at projectile velocities greater than that, if the detonative mode is to be used. For earlier stages of acceleration, a nitrogen dilutant would be used in the ambient gas. At still earlier phase, a hydrocarbon mixture using $CH_4$ (having detonation velocity <2 km/s in air), may be appropriate. Use of an injectant gas such as hydrogen or oxygen, that enhances the reaction progress, is possible because there is negligible upstream diffusion and because the jet source travels with the projectile faster than the combustion process. For these reasons, the detonation wave could not run ahead of the projectile, even though the downstream mixture (at the rear of the projectile, where the propulsive force is obtained) is more energetic than ambient.

In FIG. 1, numeral 10 generally designates a ram accelerator system, which comprises a mechanism 11 for introducing the projectile at an initial velocity into the accelerator barrel, viz. a pre-accelerator gun, which may be of any conventional structure and is not a part of the invention; and an accelerator barrel 12, which may consist of one segment or of any suitable number of segments 12*a*, . . . , 12*n*. Numeral 13 indicates a sabot stripping and gas-venting section, better described hereinafter. 14 schematically indicates the projectile. Numeral 15 indicates the wall of the barrel (tube) which may be close to the projectile for internal propulsion, or far removed for external propulsion. Also, a barrel may be used which comprises a first, internal propulsion, ram accelerator section, followed by an external propulsion section, each section having the diameter appropriate to its propulsion mode. The shaded area within the barrel is occupied by the combustible gas mixture.

The pre-accelerator is a conventional gun, or a light gas gun or an electrothermal gun that is meant to impart as high a velocity as possible. If the ram acceleration is to be carried out in the detonative supersonic combustion mode, then the projectile velocity must be above the detonation velocity of the ram accelerator gas mixture (about 3 km/s for $H_2$—$O_2$). For subsonic combustion modes, available only in the internal propulsion method, lower initial projectile velocities are needed (1–1.5 km/s).

The sabot stripping and gas-venting section 13 is a large diameter chamber, either evacuated or open to atmosphere, where the sabot can separate from the projectile (see FIG. 5), and the gas from the gun is allowed to vent. Means for intercepting the separating sabot, without causing damage to any part of the apparatus, should be included In an embodiment of the invention, the ram accelerator comprises a number of segments, each filled with a different combination of gases and separated by a diaphragm from its neighbor, the ends being similarly closed. This structure is necessary in the internal propulsion mode, because as the projectile accelerates, its shock wave inclines further and reflects from the barrel further downstream. By using gases with a higher speed of sound, the Mach number and thus the inclination angle can be controlled, thus keeping the reaction wave close to the desired location. In the external mode, the segmentation is not necessary, though it may still be useful, if the initial projectile velocity is too low. In such a case, it would be possible to operate in the internal propulsion mode in a first portion of the ram accelerator and provide a subsequent portion having a wider barrel to operate in the external propulsion mode.

Figure 2:
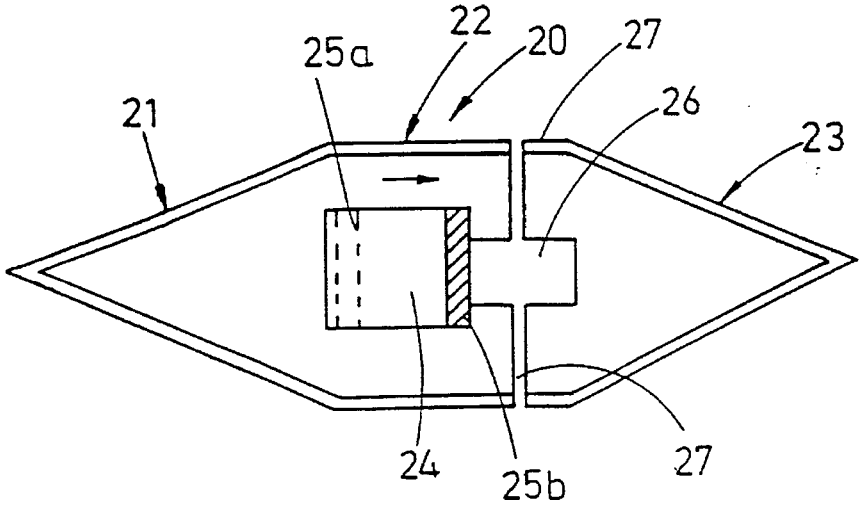
FIG. 2 schematically illustrates in axial cross-section a projectile according to an embodiment of the invention.

FIG. 2 schematically illustrates, in axial cross-section, a projectile according to an embodiment of the invention. In it, a projectile 20 is simply composed of a divergent conical front section 21, an intermediate cylindrical section 22 and a rear convergent conical section 23. Within the projectile, a chamber 24 is provided for storing the gas which will be ejected into the space between projectile and barrel. The gas is pressurized, or its initial pressure is increased, by a piston which can slide in the direction of the arrow from an initial position, shown in broken lines at 25*a*, in which it is set preceding the launch, to a final position 25*b*, shown in full lines, which it reaches due to the initial acceleration of the projectile when it is introduced into the barrel. The gas housed in chamber 24 becomes compressed into space 26 and is ejected through channels 27 which open in the surface of the projectile.

Figure 11:
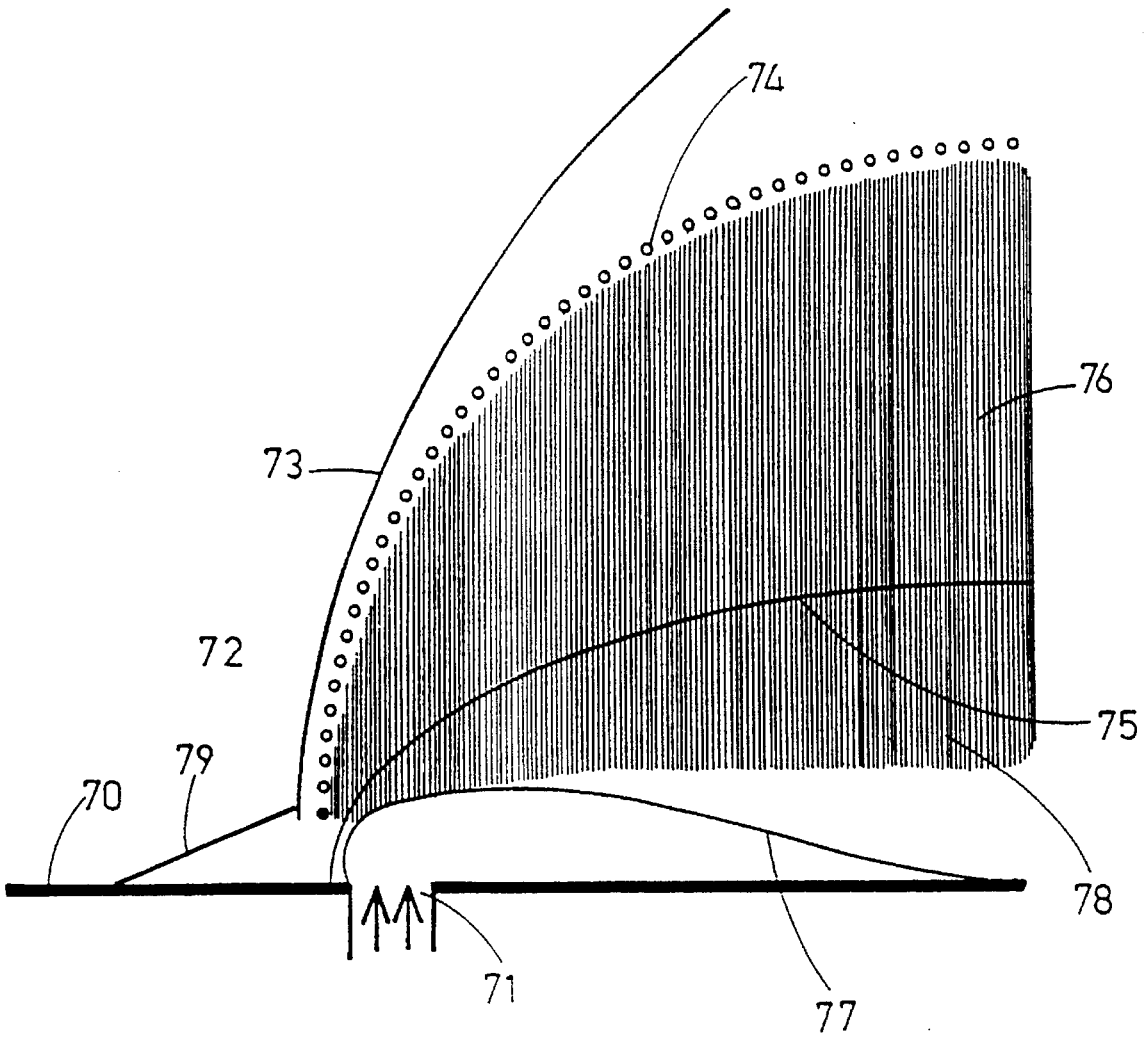
FIG. 11 schematically illustrates the jet-induced combustion according to the principle of the invention.

FIG. 11 schematically illustrates the phenomenon of the jet-induced combustion according to the invention. Numeral 70 indicates a portion of the projectile surface and 71 a jet orifice. Space 72 is occupied by combustible mixture. Line 73 indicates the shock wave. Dotted line 74 indicates the reaction front. Line 75 indicates the jet outer boundary. Space 76, between the shock wave and the jet outer boundary, is a region beyond the jet's influence on combustion. Line 77 indicates the outer boundary of the space in which the injectant gas constitutes 100% of the material, and no reaction is possible, while space 78, between lines 75 and 77, indicates the region influenced by the jet. In part of the region between lines 77 and 75 the reaction is enhanced by the injected species. The entire area that is shaded indicates the reaction (detonation or deflagration) region. Line 79 indicates the upstream separation shock. Of course, all the aforementioned lines are traces of surfaces on the plane of the drawing.

Figure 3:
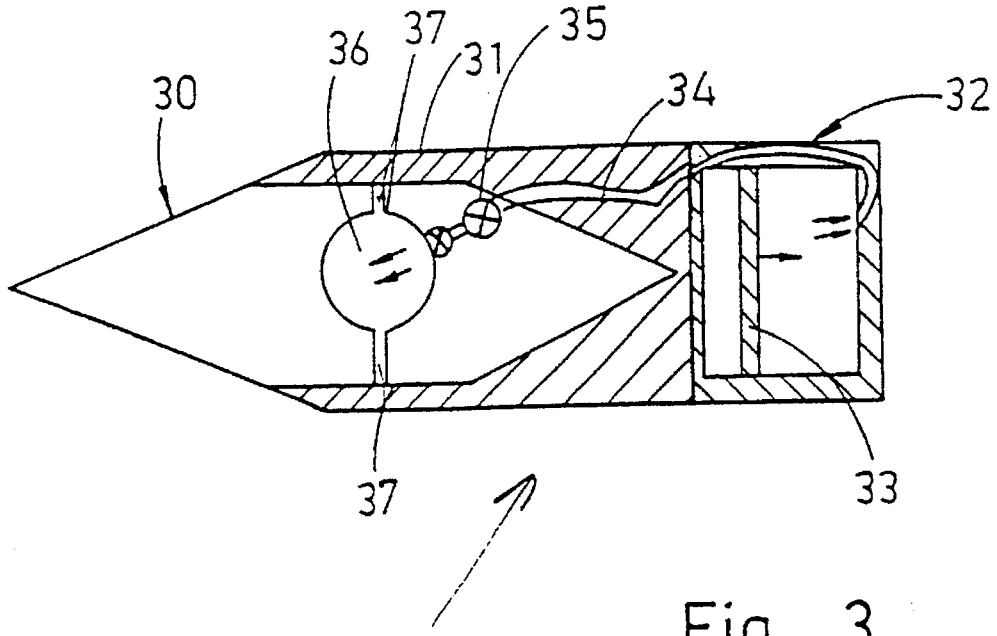
FIG. 3 schematically illustrates in axial cross-section a projectile according to another embodiment of the invention.
Figure 5:
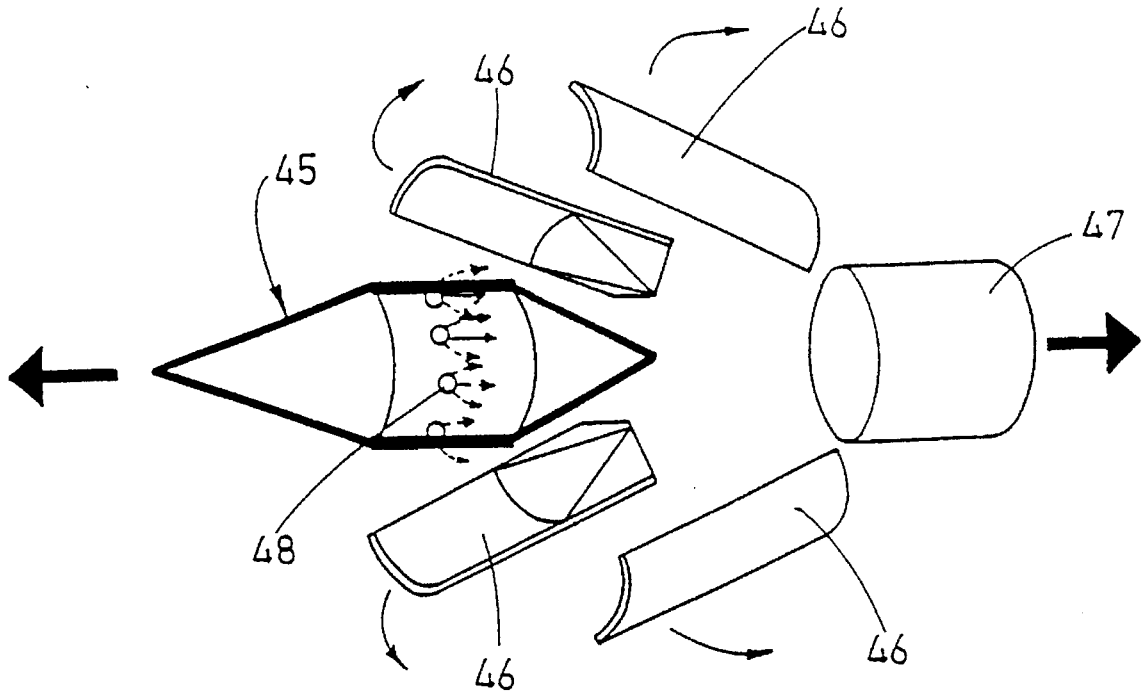
FIG. 5 is a schematic, perspective view illustrating the separation from a projectile of separable, disposable elements (sabot and pusher section)

FIG. 3 shows an alternate method of providing the desired compressed gas. Numeral 30 indicates the projectile. The cylindrical section 31 is a separate and expendable component, or "sabot". Although this is not shown in the drawing, section 31 is made of segments, as shown in FIG. 5. Section 31 is followed by a separable gas compressor device 32 of the piston type (see FIG. 5), which also serves as a pusher plate in the gun section. The provision of said separate components avoids the necessity of providing a large storage volume in the projectile, as is required by the configuration of FIG. 2. Numeral 33 indicates the piston of said compressor device, which piston may be actuated by the projectile acceleration or pyrotechnically (explosively) actuated. As the compressor device moves in the direction of the arrow at the launching of the projectile, piston 33 compresses the gas and conveys it through a channel 34 and a one-way valve 35, to a cavity 36 within the projectile, from which the gas issues through channels 37 into the accelerator barrel. Before entering the accelerator section, the components 31 and 32 are separated from the projectile, as shown in FIG. 5. In a variant of the embodiment described, the pusher cylinder is partially open at the rear and the piston moves from the rear forward. Then the high pressure gases from the gun breach will push the piston, or equivalent means, forward. If piston 33 is actuated either as above or by pyrotechnic means, then it should move in the reverse direction, which would allow channel 34 to be much shorter and to connect the left hand (as seen in the drawing) side wall of device 32 directly to cavity 36.

Compressed gas could also be precharged into the projectile prior to loading it into the ram accelerator installation and its premature discharge could be prevented by plugs, which would be removed before entering, or inside the accelerator barrel. Said plugs could also be diaphragms that are removed or broken in response to the acceleration of the projectile, either inertially or pyrotechnically by an acceleration sensor.

Figure 4:
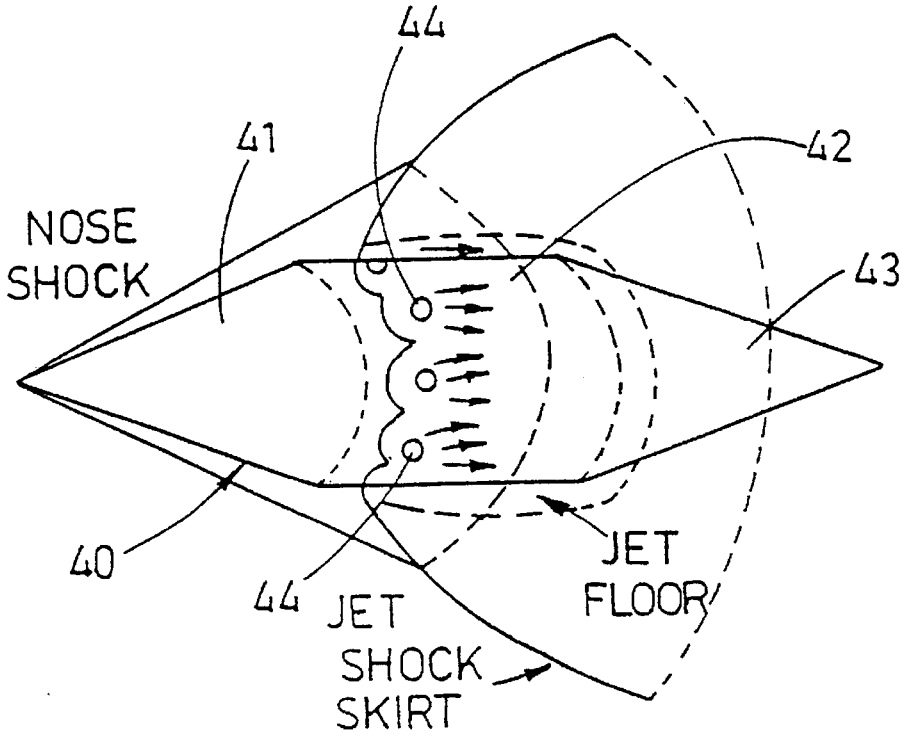
FIG. 4 is a schematic, perspective view of a projectile and its main flow field features, according to embodiments of the invention.

FIGS. 4 and 5 further illustrate in schematic perspective view a projectile according to an embodiment of the invention. In FIG. 4, the projectile 40 is composed of divergent, cylindrical and convergent sections 41, 42 and 43 respectively, and in section 42 outlets 44 are provided for the ejection of the gas from the inside. The shock wave and the jet shocks caused by the ejection of the jet are illustrated in the drawing. The ejection outlets 44 are shown in the figure as being circular, but they could be elongated slots of various width-to-length ratios or even a continuous, circular slot in the outer wall of the projectile.

FIG. 5 shows a projectile 45 which is provided with a separate and expendable component or sabot, which in the embodiment illustrated is composed of four segments 46 and a pusher section 47 (this latter corresponding to component 32 of FIG. 3). The drawing shows the sabot segments peeling off from the projectile. The sabot could comprise any number of segments and need not necessarily completely enclose the projectile. Its purpose is to guide the projectile through the gun barrel and to protect it from sliding contact with the barrel. In this embodiment, the sabot segments also serve to plug the jet nozzles 48 and to contain the high pressure gas while the projectile is in the barrel of the gun. After exiting the pre-accelerator gun, the projectile and sabot enter the stripper chamber (13 in FIG. 1). The sabot peels off sideways, being cast off from the projectile by the high pressure jets; however, other mechanical method such as springs and pyrotechnic devices may be used to cast off the sabot. The cylindrical section 47 or pusher section on the projectile serve as a pusher plate that seals the barrel behind the projectile and traps the high pressure gun gases to accelerate the projectile-sabot-pusher section assembly. It also conveniently comprises the device for producing the compressed gas, as illustrated, for instance, in FIG. 3 at 32. Rapid compression heats the gas. Thus, the gas that is ejected is at an elevated temperature, thus diminishing any cooling effect on the environment when undergoing expansion following ejection. The cylindrical section 47 may enter the ram accelerator barrel behind the projectile, but the separation distance from the projectile to said section will grow because of the high drag of the section's cylindrical surface and the acceleration of the projectile. Since the speed is hypersonic, the pusher section does not affect the projectile. The gas venting is done in the same section as the separation of the sabot.

Figure 6:
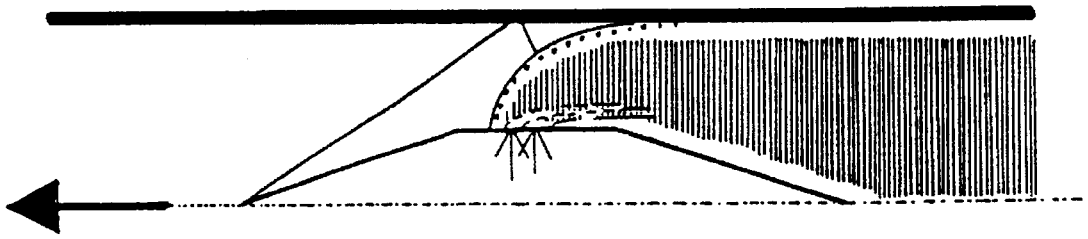
FIGS. 6, 7 and 8 illustrate modes of operation according to embodiments of the invention.
Figure 7:
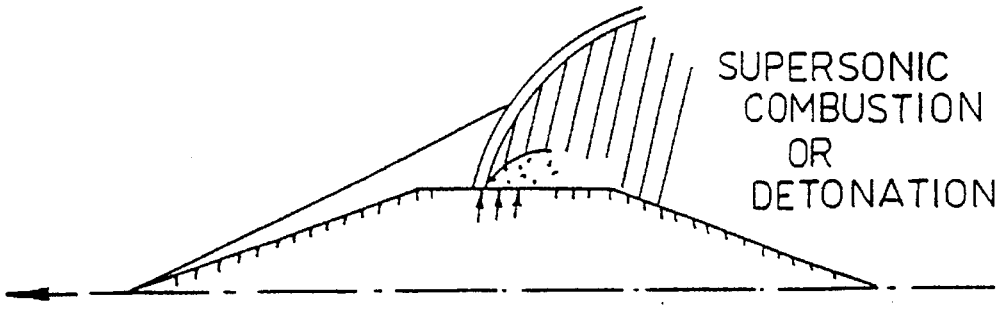
Figure 8:
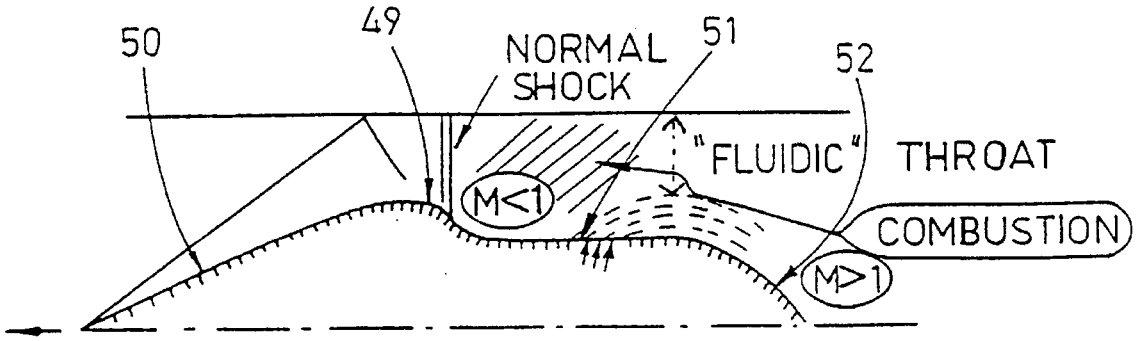

The manner in which the jet ejection is utilized to obtain several modes of propulsion, both external and internal, gas mixture is ignited in the accelerator barrel, is illustrated in FIGS. 6 to 8. In FIG. 6, the projectile having the same shape as in FIG. 2 is shown in the internal propulsion mode utilizing detonation or supersonic combustion. The injected jets produce the strong shock wave that ignites the mixture. The gas injected enhances the combustion process, by adding an amount of oxidizer or fuel. This allows the use of less than optimal gas composition in the ambient mixture, therefore lessening the possibility of premature ignition. Thrust is produced on the rear of the projectile.

FIG. 7 illustrates the behavior of a projectile having the configuration of FIGS. 2 and 6 in the external propulsion, supersonic combustion or detonation mode.

FIG. 8 shows a projectile design for use in the subsonic combustion, internal propulsion mode. It differs from the previously discussed geometry of FIGS. 6 and 7, in that this projectile has a shoulder 49 immediately following the conical nose 50, and this is followed by a cylindrical mid-section 51, ended in a contracting tail 52 (boat tail). The injected jets produce a second shoulder compressing the flow between it and the barrel (which may be called "fluidic throat"). This chokes the flow, producing a normal shock wave on the forward narrowing shoulder. The shock wave ignites the flow, and gives rise to subsonic combustion downstream of it. The flow accelerates over the boat tail and accelerates the projectile. The injectant gas acts much like an afterburner, adding to the energy of the flow. It is also conceivable that the locations of jet 51 and shoulder 49 could be switched. In this case the jet will promote the reaction through its shock wave and it will have a direct influence on the combustion by altering the composition of the mixture. An added benefit of the forward located jet is that it will help keep the projectile centered in the barrel by interacting with it.

Figure 9A:
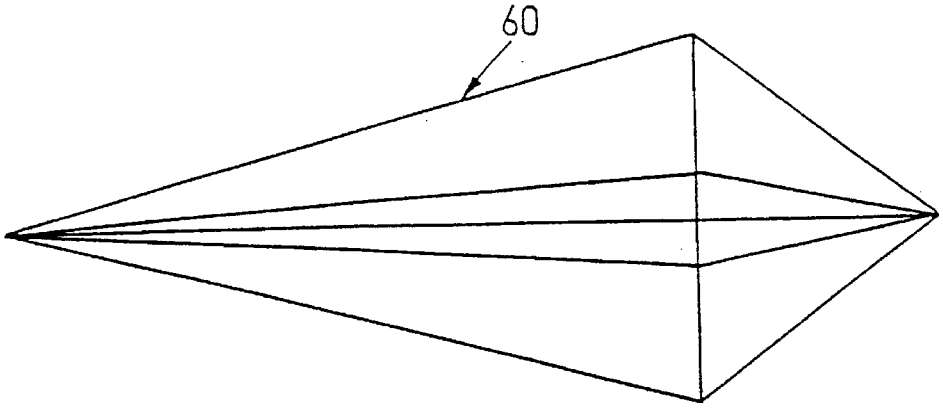
FIGS. 9 (*a*), (*b*) and (*c*) schematically illustrates in side view and in transverse cross-sections, respectively, projectiles of the Waverider type.
Figure 9B:
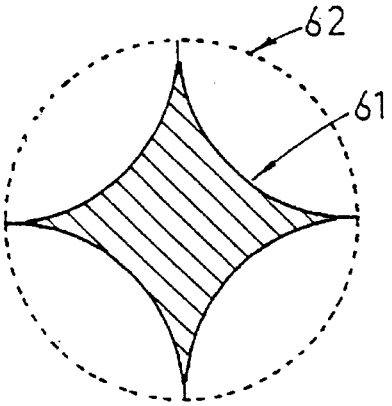
Figure 9C:
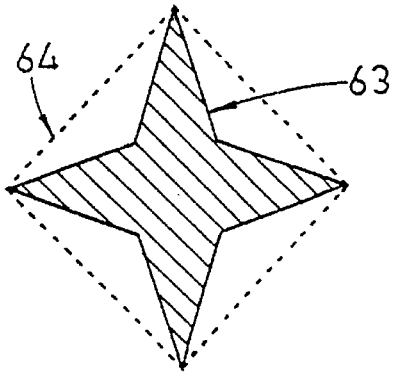

FIGS. 9(*a*), (*b*) and (*c*) illustrates two possible projectile variants of the Waverider type, which would lead to an optimized aerodynamic configuration.

FIG. 9(*a*) shows such a projectile 60 in side view. FIG. 9(*b*) shows the cross-section of the forward portion of the projectile, in a variant thereof having a symmetrical star shape composed of curved surfaces 61, shown in full lines, which supports a conical shock, the outline of which is shown in a dotted line at 62. The forward portions of these bodies are designed consistent with the Waverider principle, requiring that the shock wave be fixed to the sharp leading edges of the body. In this manner high pressure is created between the shock and the body surface. As is known in the art, star cross-sections have drag benefits compared to other shapes having, e.g., the same volume. These shapes are useful for hypersonic missile applications. FIG. 9(*c*) shows a cross-section of the forward portion of the projectile, in a variant thereof having plane outer surfaces 63. Said surfaces are shown in full lines. Dotted lines 64 show the shock surface produced by this configuration, also composed of plane surfaces.

Figure 10:
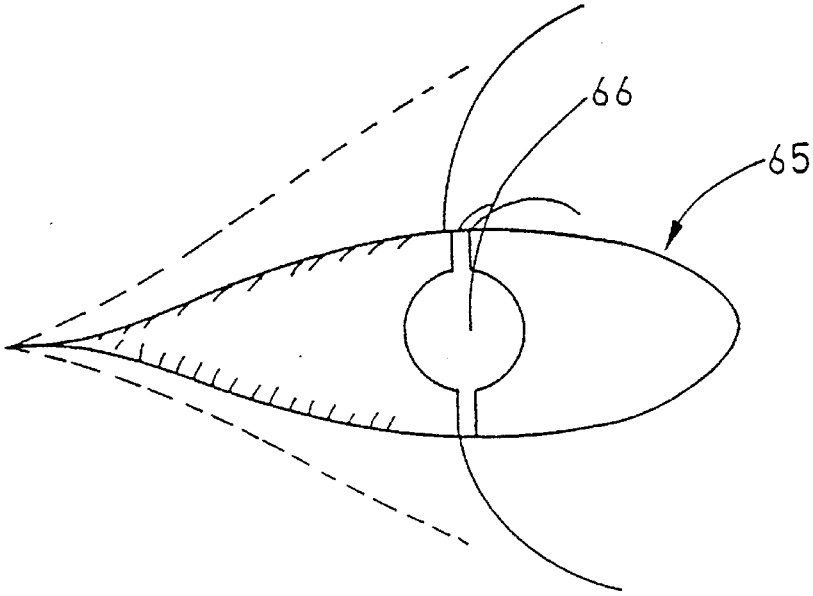
FIG. 10 is a schematic axial cross-section of a projectile with aerodynamically optimized nose section, according to still another embodiment of the invention.

FIG. 10 schematically illustrates a projectile shape optimized for drag. The optimal shapes attempt to keep the nose shock as weak as possible to decrease wave drag. The present invention permits a projectile shape to be derived by a process of such an optimization, since in it there is less reliance on the nose shock to heat and compress the gas than in the prior art. FIG. 10 is intended to illustrate this concept and not to suggest an actual, precise projectile shape. Projectile 65 has a continuous curved outer surface and houses a chamber 66 for compressed gas, which may be filled with compressed gas e.g. as illustrated in FIG. 3.

The gas carried and ejected by the projectile can be either the fuel, or the oxidizer or a different, inert gas. As hereinbefore mentioned, various ways of providing the injected gas may be used.

a) The gas may be pre-loaded at the desired pressure through an outside source and its ejection be accomplished by opening jet ports when the sabot is stripped prior to the projectile's entry into the ram accelerator barrel. The sabot will then act as a plug. Or, alternatively, plugs can be provided and blown out by using pyrotechnic means.

b) The gas to be ejected may be compressed by a piston-type arrangement, as shown in FIGS. 2 and 3.

c) The gas may be pre-loaded at a certain pressure and its pressure be increased by piston-type arrangement as in b).

d) The gas may be initially charged at a low pressure into the compartment within the pusher section aft of the projectile, and compressed and injected into the projectile either before or during the gun launch, by a piston activated either pyrotechnically or inertially or by high pressure gun gases, to provide high pressure gas for ejection from the projectile, the pusher section being discarded together with the sabot before entering the accelerator.

e) The gas may be generated before launch by a gas generator provided within the pusher section and supplied at high pressure to the projectile.

f) The gas may be generated within the projectile itself by a gas generator before launch.

If the projectile has the shape of FIGS. 2 or 3 or a similar one, fins can be added to enforce stability or to help guide it through the barrels.

The system of gas injection according to the invention may also serve similar purposes such as:

to cause a shock wave upstream of the jets that will heat and compress the ambient gas mixture sufficiently for reaction to take place;

to cause ignition by acting as a catalytic agent;

to alter in a favorable manner and in the desired location the gas mixture within the barrel to promote reaction only where wanted;

to permit use of less than optimal reactive mixture (either fuel rich or oxygen rich) in the ambient mixture, thereby to prevent premature ignition and consequent destructive deceleration of the projectile;

to anchor the reaction, either deflagration or detonation, close to the jet;

to enable the modes of propulsion known as supersonic combustion and detonation in both internal and external propulsion mode;

to enable subsonic combustion in the internal propulsion mode by acting as a second (fluidic) throat that chokes the flow ahead;

to provide control of the projectile while in the barrel by acting as a fluidic bearing (a layer of dense gas that would tend to keep the projectile away from the tube wall and centered);

to increase the aerodynamic stability of the projectile by suitable sizing and orientation of fins in the presence of the jets, when using the external propulsion mode;

to increase the aerodynamic stability of the projectile by inducing spin about the axis through directing the jets at a slight side angle, when using the external propulsion mode;

to provide an impulse control system by utilizing part of the jets for control and guidance of the projectile after launch.

FIGS. 12(*a*), 12(*b*) and 12(*c*) schematically illustrate the use of jets and interaction effects from maneuvering the projectile within and outside the atmosphere. FIGS. 12(*a*) and 12(*c*) relate to maneuvering within the atmosphere and show how the high pressure in front of the jet and the low pressure behind the jet, which is situated at the center of gravity, will produce a moment turning the vehicle with respect to the flow. This induces an angle of attack, which in turn causes an aerodynamic lift force to act on the vehicle. This lift, together with the jet thrust and the aerodynamic interaction effects, provides a force pushing the vehicle in the desired direction. The vehicle must be aerodynamically stable to align itself with the flow after the maneuver is completed, and for this purpose, for example, fins, flares or other devices may be provided.

FIG. 12(*c*) shows that the same system, used in a vacuum, will provide the jet thrust force only, which will impart a shifting sideways motion to the projectile.

Figure 13A:
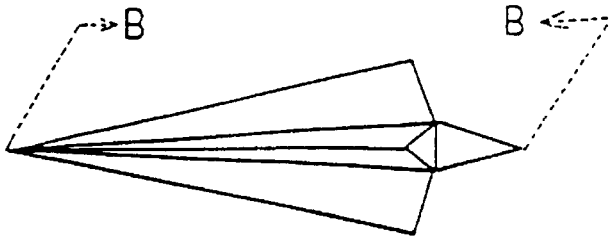
FIGS. 13(*a*) and (*b*) illustrate the behavior of a Waverider projectile in atmospheric flight.
Figure 13B:
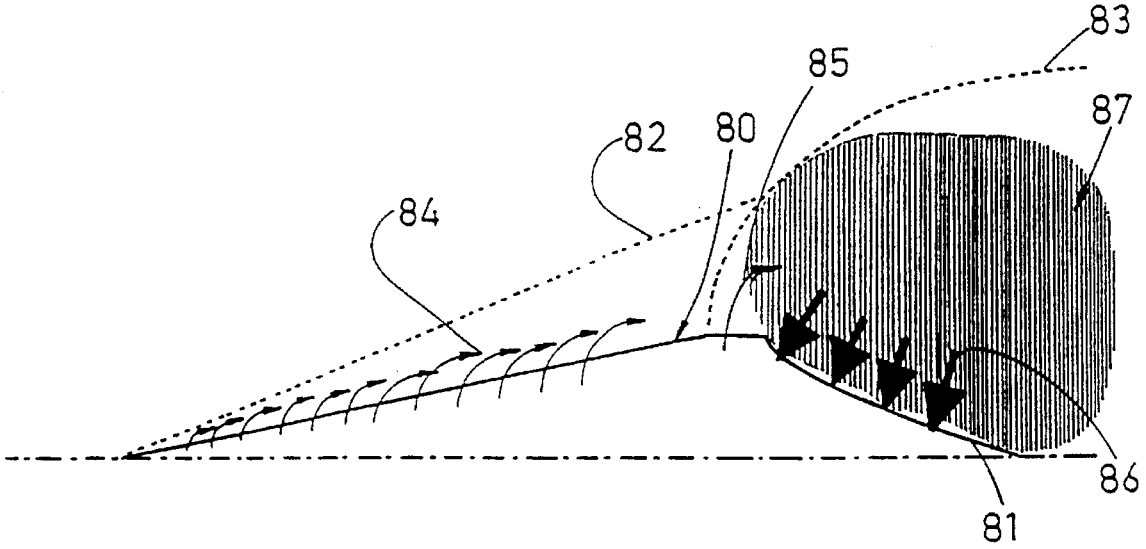

FIGS. 13(*a*), and (*b*) illustrate the application of this invention to the external propulsion detonative mode for use on large vehicles (missiles, planes) flying in hypersonic propulsion in the atmosphere. FIG. 13(*a*) is a perspective view. The projectile's cross-section and planar shock wave are those shown in FIG. 9)(*c*). The vehicle's nose is a Waverider, while the aft body receives the thrust. FIG. 13(*b*) schematically illustrates the phenomena which occur in plane B—B of FIG. 13(*a*). Numeral 80 indicates a portion of the projectile's nose; numeral 81 a portion of the aft body. Dotted lines 82 and 83 indicate the Waverider's shock and the jet bow shock respectively. The planar shock wave produced heats and compresses the air and confines the fluid bound between the shock and the body. Relatively weak jets may be distributed along the forward portion of the body to inject fuel and mix it with ambient air, as shown by arrows 84 on said forward portion of the body in FIG. 13(*b*). Final, stronger jets may be used, as indicated at 85, to impart enough heat and compress the mixture sufficiently, via the resulting shock wave, to promote reaction. The shaded area 87 indicates the detonated gas. Thrust force will be obtained on the inward tapered back portion of the projectile, as indicated at 86.

The symmetry of the illustrated configuration would be useful for application in missiles, because it will make it easier to maneuver in all directions. As stated before, the strong jets distributed around the shoulder portion are used for generating the strong shock that serves to ignite the mixture. Therefore, no obtrusive external means for serving this purpose, such as a step or a ring mounted around the configuration, will be necessary. By varying the parameters of the jet, it will be convenient to maneuver the configuration.

While a number of embodiments of the invention have been described by way of illustration, it should be understood that the invention may be carried out by persons skilled in the art with many modifications, variations and adaptations, without departing from its spirit or exceeding the scope of the claims.

I claim:

1. Method for accelerating a projectile in an accelerator barrel comprising the steps of storing a compressed fluid in said projectile, feeding a combustible gas mixture into said barrel, pre-accelerating said projectile, introducing said pre-accelerated projectile into said barrel and ejecting said compressed fluid from said projectile within said barrel to ignite said mixture and accelerate said projectile.

2. Method according to claim 1, wherein a detonation or deflagration is created by the ejection of the fluid.

3. Method according to claim 1, wherein the fluid is a compressed gas.

4. Method according to claim 3, comprising the step of pre-loading the gas at the desired pressure.

5. Method according to claim 3, wherein the gas is compressed by mechanical means.

6. Method according to claim 3, wherein the gas is generated in the projectile.

7. Method according to claim 3, wherein the gas is retained within the projectile and released at a predetermined moment.

8. A method as claimed in claim 1 comprising the step of using the ejection of the fluid to maneuver the projectile.

9. A method as claimed in claim 1 operating in external propulsion mode, comprising the steps of directing the jets at a small side angle to induce spin for stabilization of the projectile within the barrel.

10. A method according to claim 8, wherein said projectile is maneuvered in atmospheric external propulsion mode.

11. A method according to claim 1, wherein said fluid is the fuel of the combustible gas mixture.

12. A method according to claim 1, wherein said fluid is the oxidizer of the combustible gas mixture.

13. Accelerator system, comprising, in combination with an accelerator barrel containing a combustible gas mixture and a projectile, means for storing and pressurizing a fluid in said projectile, means for imparting a desired initial velocity to said projectile before introducing said projectile into said barrel and, means for ejecting said fluid from said projectile as said projectile travels through said accelerator barrel.

14. Accelerator system according to claim 13, wherein the fluid is a compressed gas.

15. Accelerator system according to claim 14, comprising mechanical means for compressing the gas.

16. Accelerator system according to claim 15, wherein the mechanical means for compressing the gas comprise a chamber housing said gas and a piston movable in said chamber.

17. Accelerator system according to claim 16, wherein the accelerator is a ram accelerator.

18. Accelerator system according to claim 16, wherein the accelerator is an external propulsion accelerator.

19. Accelerator system according to claim 14, comprising means for retaining the gas within the projectile and releasing at a predetermined moment.

20. Accelerator system according to claim 13, comprising means for loading and compressing the fluid into the projectile.

21. Accelerator system according to claim 13, wherein said accelerator barrel has a diameter substantially 20% greater than the diameter of said projectile whereby said system operates in the internal propulsion mode.

22. Accelerator system according to claim 13, wherein said accelerator barrel has a diameter that is at least substantially three times larger than the diameter of said projectile whereby said system operates in the external propulsion mode.

23. Accelerator system according to claim 13, wherein the projectile comprises a divergent conical section, a cylindrical section, and a convergent conical section.

24. Accelerator system according to claim 23, wherein the accelerator is a ram accelerator.

25. Accelerator system according to claim 23, wherein the accelerator is an external propulsion accelerator.

26. Accelerator system according to claim 13 wherein the projectile has sharp leading edges, wherein said projectile is adapted to generate a shock wave fixed to said leading edges to create a high pressure between said shock wave and the surface of the projectile.

27. Accelerator system according to claim 13, wherein said projectile has curved outer surfaces, whereby to generate a conical shock surface.

28. Accelerator system according to claim 27, wherein the accelerator is a ram accelerator.

29. Accelerator system according to claim 27, wherein the accelerator is an external propulsion accelerator.

30. Accelerator system according to claim 13, wherein said projectile has plane outer surfaces, whereby to generate planar shock surfaces.

31. Accelerator system according to claim 13, wherein the projectile has a long and slender longitudinal shape providing a narrow nose angle and having a profile adapted to generate only a weak nose shock wave to minimize drag.

32. Accelerator system according to claim 13, wherein the projectile has a transverse shape having multiple, slender pointed edges thereby having a profile to reduce drag.

33. Accelerator system according to claim 13, wherein the accelarator is a ram accelerator.

34. Accelerator system according to claim 13, wherein the accelerator is an external propulsion accelerator.

35. Accelerator system according to claim 13, wherein said means for ejecting said fluid comprise ejection nozzles and the means for imparting said initial velocity is a pre-accelerator gun, further comprising a stripper section between said pre-accelerator gun and said accelerator barrel and means for sealing said nozzles while said projectile travels through said pre-accelerator gun, said sealing means being separable from said projectile and separating therefrom when said projectile travels through said stripper section.

36. Accelerator system according to claim 35, wherein said projectile has an outer surface and comprising a cylindrical cover covering a substantial part of said outer surface, including at least said compressed fluid ejection nozzles, said cover being made of detachable segments.

37. Accelerator system according to claim 36, wherein said cover segments are of such shape and dimensions as to guide said projectile through said pre-accelerator gun and to protect said projectile from heat and frictional wear due to contact with said barrel.

38. Accelerator system according to claim 35, further comprising a cylindrical section applied to the rear of said projectile, which seals said pre-accelerator gun behind said projectile, said cylindrical section being detachable from said projectile after said projectile leaves said pre-accelerator gun.

39. Accelerator system according to claim 28, wherein the cylindrical section contains means for compressing gas and delivering said gas, at high pressure, to said projectile.

40. Accelerator system according to claim 13, wherein said projectile has a star-shaped cross-section.

41. Accelerator system according to claim 13, wherein said projectile has an outer surface with conical shaped forward and rear sections, and straight leading edges.

42. Method for accelerating a projectile in an accelerator barrel comprising the steps of storing compressed fluid in said projectile, feeding a combustible gas mixture into said barrel, pre-accelerating said projectile to a velocity greater than the detonation velocity of said combustible gas mixture, ejecting said compressed fluid from said projectile, in a direction transverse to the direction of motion of said projectile, into said gas mixture within said barrel via a plurality of circumferentially spaced openings in the surface of said projectile, said ejected fluid reacting with said gas mixture within said barrel and external to said projectile to produce combustion and/or detonation and thereby generate a high pressure acting on the rear of said projectile and imparting forward acceleration to said projectile.

* * * * *